US006905593B2

(12) United States Patent
Kuehne et al.

(10) Patent No.: US 6,905,593 B2
(45) Date of Patent: Jun. 14, 2005

(54) METHOD FOR REMOVING CALCIUM FROM CRUDE OIL

(75) Inventors: Donald L. Kuehne, Hercules, CA (US); Lisa P. Hawker, Oakland, CA (US); David C. Kramer, San Anselmo, CA (US)

(73) Assignee: Chevron U.S.A., San Ramon, CA (US)

( * ) Notice: Subject to any disclaimer, the term of this patent is extended or adjusted under 35 U.S.C. 154(b) by 0 days.

(21) Appl. No.: 10/676,897

(22) Filed: Sep. 30, 2003

(65) Prior Publication Data

US 2005/0067324 A1 Mar. 31, 2005

(51) Int. Cl.[7] ..... C10G 21/20
(52) U.S. Cl. ..... 208/251 R; 208/252; 208/253
(58) Field of Search ..... 208/251 R, 252, 208/253

(56) References Cited

U.S. PATENT DOCUMENTS

| | | | | |
|---|---|---|---|---|
| 2,778,777 | A | 1/1957 | Powell | 208/90 |
| 3,052,627 | A | 9/1962 | Lerner | 208/251 R |
| 3,153,623 | A | 10/1964 | Eldib et al. | 204/513 |
| 3,167,500 | A | 1/1965 | Payne | 208/251 R |
| 4,432,865 | A | 2/1984 | Norman | 208/183 |
| 4,439,345 | A | 3/1984 | Duke | 516/141 |
| 4,645,589 | A | 2/1987 | Krambeck et al. | 208/251 R |
| 4,722,947 | A | 2/1988 | Thanawalla et al. | 525/303 |
| 4,778,589 | A | 10/1988 | Reynolds | 208/251 R |
| 4,778,590 | A | 10/1988 | Reynolds et al. | 208/251 R |
| 4,778,591 | A | 10/1988 | Reynolds | 208/252 |
| 4,778,592 | A | 10/1988 | Reynolds | 208/252 |
| 4,789,463 | A | 12/1988 | Reynolds | 208/252 |
| 4,853,109 | A | 8/1989 | Reynolds | 208/252 |
| 4,988,433 | A | 1/1991 | Reynolds et al. | 208/252 |
| 5,164,078 | A | 11/1992 | Hung et al. | 208/251 R |
| 5,230,284 | A | 7/1993 | Kelm | 208/251 R |
| 5,593,573 | A | 1/1997 | Kramer | 101/352.4 |
| 6,030,523 | A | 2/2000 | Varaduraj et al. | 208/253 |
| 6,187,175 | B1 | 2/2001 | Blum et al. | 208/251 R |

*Primary Examiner*—Walter D. Griffin
*Assistant Examiner*—Tam M. Nguyen
(74) *Attorney, Agent, or Firm*—Alan Klaasen; Steven R. Ellinwood

(57) ABSTRACT

A calcium-containing hydrocarbonaceous material is treated with an aqueous mixture, comprising acetate ion and an alkaline material and having a pH in the range of 3.0 to 5.0, in order to extract at least a portion of the calcium from the hydrocarbonaceous material into the aqueous phase. Acetic acid is a suitable source of acetate ion. Ammonium hydroxide, sodium hydroxide and potassium hydroxide are example alkaline materials.

21 Claims, 1 Drawing Sheet

METHOD FOR REMOVING CALCIUM FROM CRUDE OIL

BACKGROUND OF THE INVENTION

Figure 1:
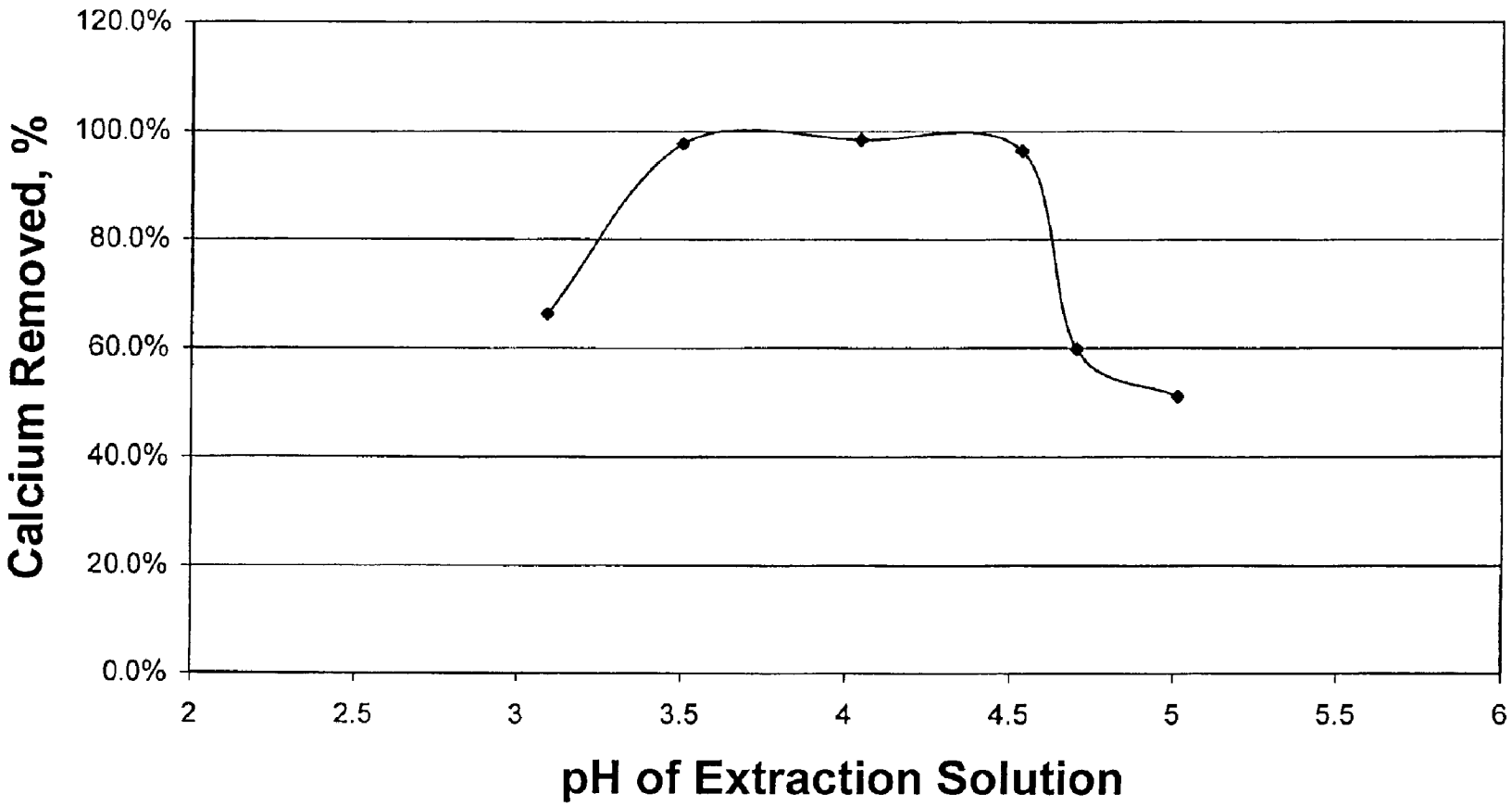

This invention relates to a process for the removal of calcium from petroleum crudes and heavy hydrocarbonaceous residua using acetic acid in an aqueous solution having a pH in a particular pH range. A number of important crude feedstocks, or the residua or deasphalted oils derived from them, contain levels of calcium which render them difficult to process using conventional refining techniques. The calcium which causes particular problems is present in these feedstocks as organically-bound compounds, which are not easily dissociated or removed by conventional water washing or desalting processes. These calcium compounds quickly decompose during typical catalytic operations, such as during hydroprocessing or during fluid catalytic cracking, causing rapid fouling or deactivation of the catalysts in the catalytic operation. It is desirable to remove these compounds before additional processing.

In U.S. Pat. Nos. 4,778,589; 4,778,590; 4,778,591; 4,778,592; 4,789,463; 4,853,109; 5,593,573 and 4,988,433, commonly assigned to the assignee of the present invention, various agents including mineral acids, aminocarboxylic acids, hydroxo-carboxylic acids, dibasic carboxylic acids, monobasic carboxylic acids and carbonic acid, and their salts, are generally taught for removing organically-bound calcium from hydrocarbonaceous feedstocks.

In Lerner U.S. Pat. No. 3,052,627, metal contaminants are removed from crude petroleum feedstocks using a 2-pyrrolidone-alcohol mixture. In Payne U.S. Pat. No. 3,167,500, metallic contaminants, such as metal-containing porphyrins, are removed from petroleum oils using a condensed polynuclear aromatic compound having a preferred C/H ratio and molecular weight. In Eldib et al., U.S. Pat. No. 3,153,623, selected commercially available organic compounds of high dielectric strength were added to assist in a process basically encompassing the electrically-directed precipitation of metals. Duke U.S. Pat. No. 4,439,345, discloses the use of carboxylic acids to demulsify by demetalizing the middle phase emulsion of an enhanced oil recovery product. Krambeck, et. al. U.S. Pat. No. 4,645,589, discloses a method for removing vanadium and nickel metal porphyrins from hydrocarbon oils using phosphoric acid and its salts. Powell U.S. Pat. No. 2,778,777, teaches the use of relatively high concentrations of sulfuric acid for the removal of porphyrinic heavy metals, such as vanadium, nickel and iron. Powell also teaches the removal of inorganic metal salts of light metals, such as calcium, sodium, and magnesium, also using relatively high concentrations of sulfuric acid, and ordinary desalting technology.

Japanese Patent Publication Sho No. 5230284, Fushimi, teaches a method for removing various metal contaminants from crude oil using a combination of mineral acid, alkyl phosphate ester and an oxidant. Japanese Patent Publication Sho No. 4722947 teaches a lower level of metals removal using a combination of alkyl phosphate esters and alkyl carboxylic acid in the presence of mineral acids.

Norman U.S. Pat. No. 4,432,865, teaches a process for treating used motor oil to remove metals using a polyhydroxy compound and a polyfunctional mineral acid.

However, a need remains for cheaper and more efficient methods for removing calcium from petroleum oils.

SUMMARY OF THE INVENTION

The present invention is directed to a method for removing calcium from hydrocarbonaceous materials, where the process comprises:

a) contacting a hydrocarbonaceous material with an extraction solution, which comprises acetate ion and has a pH in the range of between 3.0 and 5.0, to form a multi-phase mixture;

b) maintaining the multi-phase mixture at a temperature within the range of 25° C. and 175° C. and for a time sufficient to remove at least a portion of the calcium present in the hydrocarbonaceous material; and c) separating the multi-phase mixture into at least a calcium-enriched aqueous mixture and a calcium-reduced hydrocarbonaceous material.

In a specific embodiment, the source of acetate ion is acetic acid. In a separate embodiment, the extraction solution further comprises an alkaline material. Ammonia, ammonium hydroxide and sodium hydroxide are examples of suitable alkaline materials. In this embodiment, the alkaline material is included in an amount sufficient to yield an extraction solution having a pH in the range of between 3.0 and 5.0. The time required to maintain the multi-phase mixture at the given temperature in order to achieve the desired calcium removal will be in the range of from 1 second to 4 hours.

Among other factors, the present invention is based on the discovery that a surprisingly high amount of calcium is removed from contaminated hydrocarbonaceous material when using an extraction solution comprising acetate ion and having a pH in the particular range. While not wishing to be bound by theory, it is believed that the acetate ion at the particular pH facilitates the decomposition of the calcium-containing components in the hydrocarbonaceous material, and provides a mechanism for more easily transporting the calcium ions from the oil phase to the aqueous phase during the extraction process. The process is further facilitated by the addition of an alkaline material to the extraction solution in an amount needed to achieve the desired pH value.

IN THE FIGURE

FIG. 1 illustrates the amount of calcium removed over the pH range of the extraction solution of this invention.

DETAILED DESCRIPTION OF THE INVENTION

Various petroleum crude oils and residua produced from them contain unacceptably high levels of organically-bound calcium contaminants. These contaminants form insoluble residues in petroleum streams during processing, and deposit on furnace walls, process lines, and particularly within catalytic reaction zones: During reaction in catalytic reaction zones, such as, for example, in fluid catalytic cracking or during hydroprocessing, calcium which is present in reacting petroleum streams deposits on the catalytic particles, in the catalytic particles, or in the interstices between particles. The deposited calcium deactivates or fouls the catalyst, and may also cause an unacceptably high pressure drop through the reaction zone. This invention comprises a method for removing the calcium contaminants prior to catalytic processing of the crude or residua by using an aqueous solution of acetic acid or another source of acetate ion, which is prepared to have a pH in a particular range.

The invention can be applied to any hydrocarbonaceous material containing an unacceptably high level of calcium. Those materials can include crude petroleum, especially from particular sources, such as San Joaquin Valley crude (including, for example, South Belridge, Kern Front, Cymric Heavy, Midway Sunset), Shengli No. 2 from China, Kome from Chad, Dalia from offshore Angola, and the Heidrun Field in the Norwegian Sea or mixtures thereof. It is within the contemplation of the invention that any other hydrocarbonaceous materials, such as shale oil, liquefied coal, beneficiated tar sand, gas condensate etc., which may also contain similar metal contaminants, may be processed using this invention. Additional refinery streams which may be treated using the present process include a residuum fraction, a vacuum residuum fraction, a deasphalted oil and a SDA tar. Hydrocarbonaceous materials which may be treated in the present process contain a measurable amount of calcium. Hydrocarbonaceous materials containing greater than 50 ppm calcium, or greater than 100 ppm calcium, may also be suitably treated.

In the method of the invention, a hydrocarbonaceous material, such as a crude oil, a residuum or a deasphalted oil is mixed with an aqueous solution of acetic acid or salts thereof and an alkali or salts thereof. The mixture of the aqueous solution and the hydrocarbonaceous material produces an aqueous/organic multi-phase mixture. The calcium in the organic phase is transported across the interface between the two phases and dissolves in the aqueous phase. Monobasic carboxylic acids, and acetic acid in particular, are members of a broad class of multidentate chelating ligands which complex or coordinate metal ions. These compounds form very stable metal ligand complexes. When complexed with calcium, they are stable and can be isolated. They are also water soluble, allowing for their separation from hydrophobic phases. Without wishing to be bound by theory, it is believed that at least a portion of the calcium in the organic phase is chemically associated with molecules in the organic phase, and that the removal of calcium from the organic phase involves a dissociation of these calcium-containing organic species. The surprisingly high calcium removal which has been found in the pH range of between 3.0 and 5.0 appears to be related to the pH at which the organically bound calcium is most easily dissociated and therefore optimally removed from the organic phase. The pH range of between 3.0 and 5.0 appears further to provide a low interfacial tension between the aqueous and organic phases, thereby facilitating the transport of calcium across the interface and into the aqueous phase.

The extraction solution comprises a source of acetate ion, and preferably acetic acid: $CH_3COOH$; molecular weight 60.04, known also as ethanoic acid. While other materials have been found to remove some of the calcium from the material, such as sulphate ion or oxalate ion, acetate is preferred. The acetate ion may be provided as any soluble acetate salt or acetic acid, so long as the pH of the aqueous solution is within the desired range. Within a fairly broad range, the amount of calcium removed is determined by the amount of acetate ion used in the extraction solution. The extraction solution generally contains at least 0.5 mole of acetate ion per mole of calcium contained in the hydrocarbonaceous material. Good results are obtained when the extraction solution contains at least 2 moles of acetate ion per mole of calcium contained in the hydrocarbonaceous material. An extraction solution containing in the range of 4 moles to 9 moles of acetate ion per mole of calcium contained in the hydrocarbonaceous material removes high amounts of the calcium from the material.

As used herein, the extraction solution comprises acetate ion in aqueous solution. Depending on the process, the extraction solution may also contain an alkaline material, or alternatively is prepared to receive an alkaline material during one of the steps of the extraction process.

Any soluble inorganic alkaline material may be used as the alkaline component in the aqueous solution. A sufficient amount of alkaline material is added to the aqueous solution to make an extraction solution having a pH in the range of 3.0 to 5.0. Good extraction results may also be obtained with an extraction solution having a pH in the range of between 3.1 and 4.7, or further between 3.5 and 4.6. Example alkaline materials include ammonia: $NH_3$, ammonium hydroxide: $NH_4OH$, sodium hydroxide: NaOH, and potassium hydroxide KOH. Mixtures of alkaline material may also be used. The choice of alkaline material depends on the particular application. The ammonia-containing alkaline materials appear to be slightly more efficient at removing calcium; these alkaline materials may also be somewhat easier to recover following use. NaOH and KOH, being solids, are generally easier to handle.

The amount of extraction solution which is used for removing calcium from the hydrocarbonaceous material depends on a particular operation. In general it is desirable to use as small a volume of extraction solution as needed to achieve the particular level of calcium removal. For use in a crude desalter or similar two-phase separation process, a multi-phase mixture having a composition of at least 2 parts by weight of extraction solution per 100 parts by weight of hydrocarbonaceous material is desirable. Alternatively, it is desirable to operate at a ratio of between 3 parts by weight of extraction solution per 100 parts by weight of hydrocarbonaceous material to 50 parts by weight of extraction solution per 100 parts by weight of hydrocarbonaceous material If, after the extraction solution is contacted with the hydrocarbonaceous material, there is insufficient amount of extraction solution to meet the requirements of a particular extraction process, additional water or an aqueous solution may be added up to the desired amount.

In the present process, a hydrocarbonaceous material is contacted with an extraction solution, which comprises acetate ion and has a pH in the range of between 3.0 and 5.0, to form a multi-phase mixture. In one embodiment, the extraction solution is prepared by blending a source of acetate with an alkaline material in aqueous solution to prepare the extraction solution having a pH in the range of between 3.0 and 5.0. The extraction solution is then contacted with the hydrocarbonaceous material at conditions sufficient to remove calcium from the hydrocarbonaceous material. In another embodiment, an extraction solution containing a source of acetate in aqueous solution is contacted with the hydrocarbonaceous material to form a multi-phase mixture. An aqueous solution of an alkaline material is added to the multi-phase mixture with stirring at conditions sufficient to remove calcium from the hydrocarbonaceous material.

In another embodiment, an aqueous solution containing a high concentration of acid plus a high concentration of alkaline material is added to the calcium-containing oil, with the aqueous solution having a pH in the range of 3.0 to 5.0. Extra water, or an aqueous solution, is then added to achieve the desired dilution of the extraction solution.

The extraction solution is contacted with the hydrocarbonaceous material in a mixer which permits effective contacting of the aqueous and hydrocarbonaceous phases. Any mixing system suitable for mixing two immiscible liquid phases would be considered suitable for the present process, e.g., in-line mixers, mixing valves, mixing tanks, stirrers, homogenizers, and the like. Commercial desalters, for example, ordinarily run at 10% or less aqueous volume. Countercurrent extraction may also be used for separation.

After thorough mixing, the multi-phase mixture is separated into a calcium-enriched aqueous mixture and a calcium-reduced hydrocarbonaceous material. In some cases, the multi-phase mixture will easily separate into aqueous and organic phases and each of the phases recovered by a simple decanting process. However, an emulsion often forms, and must be broken or demulsified before the aqueous and organic phases can be separated. Methods for making this separation are well-known, and include, for example, use of a centrifuge, a desalter, and an electrical potential. Breaking an emulsion may also be facilitated by use of a demulsifying agent.

The calcium acetate complex which is formed during the extraction process is ionic and water soluble, and is therefore extracted into the aqueous phase of the mixture. The calcium-enriched aqueous solution is separated from the calcium-reduced hydrocarbonaceous material, which then can be handled in the same manner as any other carbonaceous feed. It is contemplated that the physical separation process may suitably be done in a conventional crude desalter, which is usually used for desalting petroleum crudes. The separation may be done by any separation process, however, and may include countercurrent extraction. In a separate embodiment, the calcium removal process may be conducted in a crude dewatering process. Crudes which are associated with sufficient produced water may be treated with the acetic acid and with an alkaline material without extra water being added. The separation process which removes the treated produced water from the crude oil further removes at least a portion of the calcium from the crude oil. Such separations normally are done at temperatures lower than a typical desalting operation.

It is desired to remove at least 30% by weight of the calcium in the hydrocarbonaceous material during the extraction process. Removing at least 60% is preferred. The time required to achieve this level of removal depends on the mixing and separation equipment, on the temperature and on the hydrocarbonaceous material being processed. When a stable emulsion is formed during the contacting, the time required to break the emulsion and to separate the two phases will generally be longer than when the emulsion is easier to break. Likewise, it is expected that the extraction process will result in high calcium removal rates in less time when the extraction is operated at higher temperatures. Suitable separations can be achieved in times varying from less than a few seconds to greater than 24 hours. Normally, a suitable separation will be achieved in a time between about 1 second and about 4 hours, and often in a time between about 1 minute and about 1 hour.

The extraction process is generally conducted at a temperature below the boiling point of water at the process pressure. Extraction temperatures are typically in the range of 25° C. to 200° C. In one embodiment, the extraction process is maintained at extraction conditions which include a temperature within the range of 110° C. and 200° C. for a time between about 1 second and about 4 hours. In a separate embodiment, a preferred extraction process is maintained at extraction conditions which include a temperature within the range of 25° C. and 110° C. for a time between about 1 second and about 4 hours. Pressures of greater than atmospheric pressure are typical. Pressures are preferably selected to be greater (e.g. at least 25 psig greater) than the vapor pressure of the aqueous phase at the extraction and separation temperature.

EXAMPLES

Data tabulated in Table I were collected as follows: Eight (8) grams of distilled water were combined with 1.0 N acid in an 8-dram vial to yield the desired acid concentration. Sufficient alkaline material was added to the acidified solution to bring the pH of the solution to a target value, and then sufficient water was added to bring the total weight of the resultant extraction solution to 10 grams. This extraction solution was then combined in the same vial with 10 grams of a calcium-containing crude oil, which had been heated to 70° C., and the mixture returned to the oven for reheating to 70° C. The combined mixture of crude oil and the extraction solution was vigorously shaken for 1 to 2 minutes, and then returned to the oven for reheating at 70° C. for sufficient time to permit the mixture to separate, at least partially, into two phases. After separation, a sample of the oil phase and a sample of the extraction phase were removed and each tested for metals content using ICP (inductively coupled plasma) metals analysis. The calculated amount of calcium removed was based on the analysis of the calcium remaining in the oil phase after the extraction step, compared with the amount of calcium originally present in the crude oil. In some of the tests, an extraction aid such as IPA (iso-propyl alcohol) or a demulsifier (DM), such as Baker Petrolite DM046X, were added to the extraction solution to test the effect of these additives on the extraction and phase separation. Two calcium-containing crudes, both of African origin, were evaluated in the tests. Crude oil #1 contained approximately 430 ppm calcium. Crude oil #2 contained approximately 230 ppm calcium. In all of the tests described below, the water/oil ratio (w/w) was 1.

Example 1

Eight (8) grams of distilled water were combined with 0.5 grams of a 1.0 N solution of acetic acid in an 8-dram vial. Sufficient ammonia solution ($NH_4OH$) was added to the acidified solution to yield a pH of 4.04 (Test No. 1A). This extraction solution was then combined in the same vial with 10 grams of a calcium-containing crude oil as detailed above. ICP analysis showed that 98.4% of the calcium had been removed from the crude oil.

Example 2

Example 1 was repeated at a number of target pH values in Test Nos. 1B–1F. Results for Examples 1 and 2 are tabulated in Table I. The effect of pH of the extraction solution on calcium removal is also illustrated in FIG. 1. FIG. 1 clearly shows the surprisingly high amount of calcium which is removed over the pH range of from 3.0 to 5.0 of this invention.

TABLE I

Effect of pH on calcium removal from crude oil #1

| Test No. | Description | Initial pH | Calcium Removal, % |
|---|---|---|---|
| 1A | 0.05 N Acetic + NH4OH | 4.04 | 98.4% |
| 1B | 0.05 N Acetic + NH4OH | 3.50 | 97.7% |
| 1C | 0.05 N Acetic + NH4OH | 5.01 | 51.0% |
| 1D | 0.05 N Acetic + NH4OH | 4.53 | 96.3% |
| 1E | 0.05 N Acetic + NH4OH | 4.70 | 59.7% |
| 1F | 0.05 N Acetic Acid | 3.09 | 66.2% |

Example 3

The effect of changing the type of acid is illustrated in the data from Test Nos. 2A through 2C of Table II. At an equivalent acid strength, acetic acid and oxalic acid removed the calcium contained in the crude sample more effectively than did sulfuric acid. However, it should be noted that the calcium recovery when using oxalic acid was low. It is believed that oxalic acid produced an insoluble phase with the calcium impurity in the crude. This insoluble precipitate is more difficult to remove during continuous processing than is soluble calcium that is retained in the aqueous phase.

TABLE II

Effect of acid type w/crude #1

| Test No. | Description | Initial pH | Calcium Removal, % |
|---|---|---|---|
| 2A | 0.05 N Sulfuric + $NH_4OH$ | 4.43 | 23.9% |
| 2B | 0.05 N Acetic + $NH_4OH$ | 4.04 | 98.4% |
| 2C | 0.05 N Oxalic + $NH_4OH$ | 4.03 | 75.5% |

Example 4

An evaluation of the effect of the calcium extraction on the pH of the aqueous phase was tested in Test Nos. 3A through 3C. In these tests, one drop of isopropyl alcohol (IPA) was added to the extraction solution containing sulfuric acid as an extraction aid. In this test the pH of both the initial extraction solution and the aqueous phase following extraction were determined. As shown in Table III, the pH of Test No. 3A, using acetic acid, was scarcely changed during extraction, while the pH of Test Nos. 3B and 3C, using sulfuric acid, changed to a decidedly basic pH. It is believed that the inherent buffering effect of the acetic acid/acetate ion system resulted in the lower pH of the final aqueous solution. It is tempting to suggest that this buffering effect helps to maintain the aqueous extraction solution at a pH which is in the range of optimum decomposition of the organic calcium compounds present in the crude oil. Furthermore, it is theorized that the pH of the aqueous extraction solution following extraction may be in a suitable range to facilitate a reduction in the surface tension of the mixture. This would be expected to have the effect of decreasing the resistance to the migration of calcium from the oil phase to the aqueous phase

TABLE III

Comparison of strong and weak acid extraction w/crude #2

| Test No. | Description | Initial pH | pH After Extraction | Calcium Removal, % |
|---|---|---|---|---|
| 3A | 0.05 N Acetic + $NH_4OH$ | 4.46 | 4.73 | 79.9 |
| 3B | 0.1 N Sulfuric + NH4OH + IPA | 6.39 | 8.25 | 49.0 |
| 3C | 0.1 N Sulfuric + NH4OH + IPA | 4.19 | 8.21 | 50.7 |

Example 5

An evaluation of the effect of the amount of acetate ion used in the extraction solution was tested in Test Nos. 4A through 4C. The results tabulated in Table IV show that the extraction efficiency increased with increasing amounts of acetate ion. Roughly 50% of the calcium was removed when the acetate ion/calcium molar ratio was 2.1. Calcium removal increased to nearly 100% at an acetate ion/calcium molar ratio of 9.0. In Test Nos. 4A through 4C, the demulsifier Baker Petrolite DM046X was included in the extraction solution. One drop of demulsifier (about 0.012–0.014 g) that was diluted 2:1 with a hydrocarbon solvent was added to the oil phase.

TABLE IV

Effect of acetic acid concentration w/crude #2

| Test No. | Description | Initial pH | Calcium Removal, % | Acetate ion/Ca |
|---|---|---|---|---|
| 4A | 0.05 N Acetic + NH4OH + DM | 4.44 | 98.8% | 9.00 |
| 4B | 0.011 N Acetic + NH4OH + DM | 4.54 | 54.3% | 2.1 |
| 4C | 0.021 N Acetic + NH4OH + DM | 4.45 | 70.0% | 3.8 |

Example 6

Test Nos. 5A to 5B compared the effectiveness of NaOH and $NH_4OH$ for use as the alkaline material. Results are tabulated in Table V. While ammonium hydroxide appears marginally better for this use, the differences are small.

TABLE V

Effect of Alkaline Material w/crude #2

| Test No. | Description | Initial pH | Calcium Removal, % |
|---|---|---|---|
| 5A | 0.05 N Acetic + NaOH + DM | 4.40 | 88.9% |
| 5B | 0.05 N Acetic + $NH_4OH$ + DM | 4.44 | 98.8% |

What is claimed is:

1. A method for removing calcium from a hydrocarbonaceous material comprising:

a) contacting a hydrocarbonaceous material with an extraction solution, which comprises acetate ion and has a pH limited in the range of between about 3.5 to 4.6, to form a multi-phase mixture;

b) maintaining the multi-phase mixture at extraction conditions, including a temperature within the range of 25° C. and 200° C., for a time sufficient to remove at least 90 percent of the calcium present in the hydrocarbonaceous material; and c) separating the multi-phase mixture into at least a calcium-enriched aqueous mixture and a calcium-reduced hydrocarbonaceous material.

2. The method of claim 1, wherein the extraction solution is prepared by blending acetic acid with an aqueous solution of an alkaline material.

3. The method of claim 2, wherein the alkaline material is selected from the group consisting of sodium hydroxide, ammonium hydroxide, ammonia, potassium hydroxide and mixtures thereof.

4. The method of claim 3, wherein the alkaline material is ammonium hydroxide.

5. The method of claim 1, wherein the multi-phase mixture is maintained at a temperature within the range of 110° C. and 175° C. for a time of between about 1 minute and about 1 hour.

6. The method of claim 1, wherein the extraction solution has a pH in the range of between 3.6 and 4.5.

7. The method of claim 1, wherein the extraction solution has a pH in the range of between 3.7 and 4.4.

8. The method according to claim 1, wherein the extraction solution contains at least 2 moles of acetate ion per mole of calcium contained in the hydrocarbonaceous material.

9. The method according to claim 1, wherein the extraction solution contains in the range of 4 moles to 9 moles of acetate ion per mole of calcium contained in the hydrocarbonaceous material.

10. The method according to claim 1, wherein the multi-phase mixture is maintained at extraction conditions sufficient to remove at least 95 percent by weight of the calcium contained in the hydrocarbonaceous material.

11. The method according to claim 10, wherein the extraction conditions include a temperature within the range of 110° C. and 200° C. for a time between about 1 minute to about 1 hour.

12. The method according to claim 10, wherein the extraction conditions include a temperature within the range of 25° C. and 110° C. for a time between of about 1 second and about 4 hours.

13. The method of claim 1, wherein the multi-phase mixture has a composition of at least 2 parts by weight of extraction solution per 100 parts by weight of hydrocarbonaceous material.

14. The method of claim 1, wherein the hydrocarbonaceous material is selected from the group consisting of a crude oil, a residuum fraction, a vacuum residuum fraction, a deasphalted oil and a SDA tar.

15. The method of claim 1, wherein the hydrocarbonaceous material contains greater than 50 ppm calcium.

16. The method of claim 1, wherein the hydrocarbonaceous material contains greater than 100 ppm calcium.

17. The method of claim 1, wherein the extraction solution further comprises at least one additive selected from the group consisting of an extraction additive and a demulsifier.

18. A method for removing calcium from a hydrocarbonaceous material comprising:

a) blending acetic acid with an alkaline material to produce an extraction solution having a pH in the range of between 3.5 and 4.6;

b) combining a calcium-containing hydrocarbonaceous material, with sufficient extraction solution to provide at least one mole of acetate ion per mole of calcium in the hydrocarbonaceous material, to form a multi-phase mixture;

c) maintaining the multi-phase mixture at a temperature in the range of 25° C. to 200° C. for a sufficient time to remove at least 90 percent of the calcium contained in the hydrocarbonaceous material into the extraction solution; and d) separating a calcium-enriched aqueous mixture from a calcium-reduced hydrocarbonaceous material.

19. The method of claim 18, wherein the extraction solution has a pH in the range of between 3.6 and 4.5.

20. The method of claim 19, wherein the extraction solution has a pH in the range of between 3.7 and 4.4.

21. The method of claim 18, wherein the multi-phase mixture comprises at least 2 parts by weight of extraction solution per 100 parts by weight of hydrocarbonaceous material.

* * * * *